US010625225B2

(12) United States Patent
Clifton et al.

(10) Patent No.: US 10,625,225 B2
(45) Date of Patent: Apr. 21, 2020

(54) SINGLE-PASS FLOW-THROUGH DRY CHEMICAL MIXING TRAILER

(71) Applicant: Performance Chemical Company, Midland, TX (US)

(72) Inventors: Mark Clifton, Midland, TX (US); Edy Redmon, Midland, TX (US)

(73) Assignee: PERFORMANCE CHEMICAL COMPANY, Midland, TX (US)

( * ) Notice: Subject to any disclaimer, the term of this patent is extended or adjusted under 35 U.S.C. 154(b) by 0 days.

(21) Appl. No.: 15/661,573

(22) Filed: Jul. 27, 2017

(65) Prior Publication Data

US 2020/0070111 A1 Mar. 5, 2020

Related U.S. Application Data

(60) Provisional application No. 62/518,648, filed on Jun. 13, 2017.

(51) Int. Cl.

| | |
|---|---|
| ***B01F 13/10*** | (2006.01) |
| ***B01F 13/00*** | (2006.01) |
| ***B01F 3/12*** | (2006.01) |
| ***B01F 15/00*** | (2006.01) |
| ***B01F 15/04*** | (2006.01) |
| ***B01F 15/02*** | (2006.01) |

(Continued)

(52) U.S. Cl.

CPC ..... *B01F 13/1033* (2013.01); *B01F 3/1221* (2013.01); *B01F 3/1271* (2013.01); *B01F 7/16* (2013.01); *B01F 13/004* (2013.01); *B01F 13/1066* (2013.01); *B01F 15/00525* (2013.01); *B01F 15/0243* (2013.01); *B01F 15/04* (2013.01); *B01F 2005/0091* (2013.01); *B01F 2215/0081* (2013.01)

(58) Field of Classification Search

CPC ..... B01F 13/1033; B01F 15/0243; B01F 15/00525; B01F 3/1221; B01F 15/04; B01F 7/16; B01F 13/1066; B01F 13/004; B01F 3/1271; B01F 2005/0091; B01F 2215/0081

See application file for complete search history.

(56) References Cited

U.S. PATENT DOCUMENTS 3,248,093 A * 4/1966 Demaison ..... B28C 5/466 366/13

4,344,859 A * 8/1982 Burke, Jr. ..... C08J 3/03 366/124

(Continued)

*Primary Examiner* — Tony G Soohoo

(74) *Attorney, Agent, or Firm* — Nolte Intellectual Property Law Group

(57) ABSTRACT

A single-pass flow-through dry chemical mixing trailer for use with a well has a trailer, a refillable liquid storage tank, a main liquid storage tank valve, a liquid storage tank inlet valve, an onboard power supply, a motor with a fuel supply, a transmission, a fluid circulation loop, a self-priming bidirectional flow alternating centrifuge pump, an automated mixer assembly, and a discharge tank. The refillable liquid storage tank prevents backflow to the self-priming bidirectional flow alternating centrifuge pump while flowing the homogenized slurry to the well and the dry chemicals introduced at the automated mixer are subjected to high shear forces, incorporating the dry chemicals into the liquid with increased dispersion and reduced agglomeration.

18 Claims, 8 Drawing Sheets

(51) Int. Cl.
*B01F 7/16* (2006.01)
*B01F 5/00* (2006.01)

(56) References Cited

U.S. PATENT DOCUMENTS

| | | | | | |
|---|---|---|---|---|---|
| 4,518,261 | A * | 5/1985 | Sekimoto | B01F 3/1221 | 366/155.1 |
| 4,716,932 | A * | 1/1988 | Adams, Jr. | B01F 3/1271 | 137/565.29 |
| 4,764,019 | A * | 8/1988 | Kaminski | B01F 3/1271 | 366/136 |
| 5,382,411 | A * | 1/1995 | Allen | B01F 3/1271 | 366/153.1 |
| 5,609,417 | A * | 3/1997 | Otte | B01F 5/0256 | 366/137 |
| 6,193,402 | B1 * | 2/2001 | Grimland | B01F 3/1221 | 366/14 |
| 9,834,452 | B1 * | 12/2017 | Fuller | C02F 5/14 | |
| 10,011,501 | B1 * | 7/2018 | Fuller | B67D 7/74 | |
| 10,124,307 | B2 * | 11/2018 | Weinstein | B01F 3/1271 | |
| 2006/0104156 | A1 * | 5/2006 | Villwock | B01D 19/0063 | 366/184 |
| 2013/0242688 | A1 * | 9/2013 | Kageler | B01F 7/00233 | 366/139 |
| 2015/0322761 | A1 * | 11/2015 | Hodgson | E21B 43/267 | 166/308.1 |
| 2019/0009232 | A1 * | 1/2019 | Yeung | B01F 15/00272 | |
| 2019/0217258 | A1 * | 7/2019 | Bishop | B01F 15/00175 | |
| 2019/0376377 | A1 * | 12/2019 | Hodgson | B01F 3/12 | |

* cited by examiner

SINGLE-PASS FLOW-THROUGH DRY CHEMICAL MIXING TRAILER

CROSS REFERENCE TO RELATED APPLICATION

The current application claims priority to and the benefit of U.S. Provisional Patent Application Ser. No. 62/518,648 filed on Jun. 13, 2017, entitled "SINGLE-PASS FLOW-THROUGH DRY CHEMICAL MIXING TRAILER". This reference is hereby incorporated in its entirety.

FIELD

The present embodiment generally relates to single-pass flow-through dry chemical mixing trailer for portable use at multiple well sites, which optionally have remote control.

BACKGROUND

A need exists for a trailer mounted dry chemical mixing device with fluid circulation loop to provide dry chemical down wells efficiently, cost effectively, and safely.

The present embodiments meet these needs.

BRIEF DESCRIPTION OF THE DRAWINGS

The detailed description will be better understood in conjunction with the accompanying drawings as follows.

Figure 1:
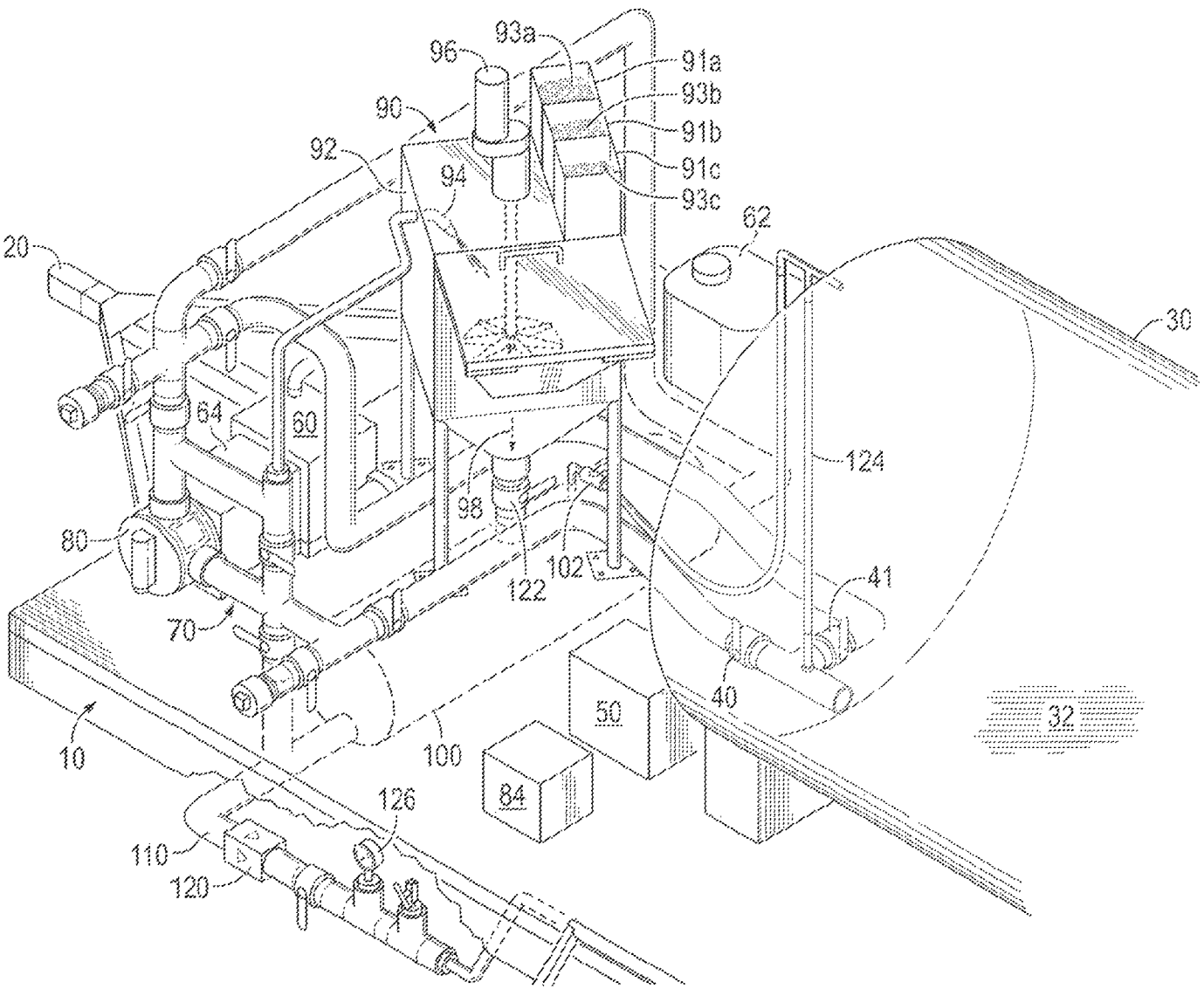
FIG. 1 depicts a perspective view of the trailer according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present invention relates to a single-pass flow-through dry chemical mixing trailer for use with a well.

The single-pass flow-through dry chemical mixing trailer for use with a well includes a trailer.

A refillable liquid storage tank is mounted on the trailer providing liquid.

A main liquid storage tank valve is connected to the refillable liquid storage tank.

A liquid storage tank inlet valve is connected to the refillable liquid storage tank.

An onboard power supply is mounted on the trailer.

A motor with a fuel supply is mounted to the trailer, the motor is connected to the onboard power supply.

A transmission is connected to the motor.

A fluid circulation loop is connected to the main liquid storage tank valve to receive liquid.

A self-priming bidirectional flow alternating centrifuge pump is connected to the transmission for transferring liquid via the fluid circulation loop sequentially and synchronously to an automated mixer assembly that additionally receives dry chemicals from a plurality of detachable dry chemical containers forming a homogenized slurry and a discharge tank with air relief valve, configured to maintain pressure in the discharge tank between 14 psi and 50 psi, wherein the discharge tank additionally receives the homogenized slurry.

The refillable liquid storage tank prevents corrosion to the self-priming bidirectional flow alternating centrifuge pump while flowing the homogenized slurry to the well.

The embodiments provide a safer environment by preventing a person from coming into contact with chemicals that cause severe illness, disease, or casualty.

The embodiments provide complete automated mixing of chemicals into liquid.

The embodiments provide the benefit of stopping toxic spills.

The embodiments are cost effective and save wear and tear on the centrifugal pump, preventing corrosive chemicals from running through the pump.

The embodiments extend the life of a well with controlled chemical injection.

The following terms are defined herein:

The term "automated mixer assembly" refers to a mixer in communication with a controller that mixes and receives dry chemicals from dry chemical containers with liquid to form a homogenized slurry.

The term "discharge tank" refers to a tank for holding the homogenized slurry before it is flushed into the well. The discharge has an air relief valve to stabilize the pressure in the discharge tank. In addition, the air relief prevents overflow of the discharge tank.

The term "fluid circulation loop" refers to a loop for circulating liquid while the pump is on to prevent the pump from malfunctioning while the valves are being opened and closed.

The term "liquid storage tank inlet valve" refers to a ball valve used to fill the refillable liquid storage tank with liquid.

The term "motor" refers to a machine that converts electrical energy into mechanical energy. The motor can be an electric start gas powered motor and the fuel supply can be diesel or gas.

The term "onboard power supply" refers to a car battery or a generator for providing from 12 volts to 24 volts of DC power.

The term "main liquid storage tank valve" refers to a ball valve used to release liquid from the refillable liquid storage tank.

The term "refillable liquid storage tank" refers to the tank used to store liquid, which mixed with dry chemicals to form a homogenized slurry.

The term "self-priming bidirectional flow alternating centrifuge pump" refers to a pump used to pump liquid in and out of the refillable liquid storage tank, the automated mixer, and to pump water into the well.

The term "trailer" refers trailer with a frame, at least one axle, a pair of wheels secured to the at least one axle, a brake secured to the at least one axle, and a tow tongue for engaging a tow vehicle.

The term "transmission" refers to a machine in a power transmission system, which provides controlled application of the power. The transmission can be gearbox that uses gears and gear trains to provide speed and torque conversions from a rotating power source to another device.

Now turning to the Figures, FIG. 1 depicts a perspective view of the trailer 10.

A tow tongue 20 is shown for engaging the single-pass flow-through dry chemical mixing trailer with a tow vehicle.

In embodiments, a refillable liquid storage tank 30 is mounted on the single-pass flow-through dry chemical mixing trailer 10 for providing liquid 32.

The refillable liquid storage tank 30 is connected to a liquid storage tank inlet valve 41.

In embodiments, the refillable liquid storage tank 30 mounted on the trailer 10 has from 100 to 300 gallons of liquid.

In embodiments, a main liquid storage tank valve 40 is connected to the refillable liquid storage tank 30.

A fluid circulation loop 70 connected to the main liquid storage tank valve 40 to receive liquid 32.

In embodiments, an onboard power supply 50 is mounted on the trailer 10.

The onboard power supply 50 can be a car battery or a generator capable of providing from 12 volts to 24 volts of DC power.

In embodiments, the onboard power supply 50 is connected to a motor 60.

The motor 60 with a fuel supply 62 is mounted to the trailer 10.

In embodiments, the motor 60 can be an electric start gas powered motor and the fuel supply can be diesel or gas.

In embodiments, a transmission 64 is connected to the motor 60.

A self-priming bidirectional flow alternating centrifuge pump 80 is connected to the transmission 64 for transferring liquid 32 via the fluid circulation loop 70 sequentially and synchronously to an automated mixer 90 and a discharge tank 100.

A ball valve 122 is located between the automated mixer 90 and discharge tank 100 for controlling mixed liquid flow.

The automated mixer 90 additionally receives dry chemicals 93*a*-93*c*, such as scale inhibitor, paraffin inhibitor, water treatment, corrosion inhibitor, and $H_2S$ scavenger from a plurality of detachable dry chemical containers 91*a*-91*c* forming homogenized slurry 98.

In embodiments, the automated mixer assembly 90 contains a tank 92 for receiving sequentially liquid and dry chemicals, a mixing nozzle 94 creating turbulent mixing in the tank, and a high-shear assembly 96 in the tank 92 for incorporating dry chemicals into the liquid forming the homogenized slurry 98.

The discharge tank 100 has an air relief valve 102 configured to maintain pressure in the discharge tank from 14 psi and 50 psi, wherein the discharge tank additionally receives the homogenized slurry.

Additionally, the air relief valve 102 sends homogenized slurry 98 overflow back into the refillable liquid storage tank 30.

In embodiments, the single-pass flow-through dry chemical mixing trailer contains a gauge 124 for determining quantities of liquid removed from the refillable liquid storage tank enabling continuous monitoring of liquid 32 to the automated mixer by the controller.

A conduit 110 is mounted to the single-pass flow-through dry chemical mixing trailer for flowing to the well. The conduit can have an inner diameter from one inch to three inches.

A check valve 120 is located in the conduit 110 to control flow to the well.

In embodiments, pressure gauge 126 is connected to the conduit 110 for providing an alarm to the controller if the pressure in the conduit 110 exceeds preset pressure limits.

The refillable liquid storage tank 30 prevents backflow to the self-priming bidirectional flow alternating centrifuge pump 80 while flowing the homogenized slurry to the well. The dry chemicals introduced at the automated mixer are subjected to high shear forces, incorporating the dry chemicals 93*a*-93*c* into the liquid 32 with increased dispersion and reduced agglomeration.

In embodiments, mixing of dry chemical to liquid can be a ratio from 1:1:1 to 10:5:9.

Figure 2:
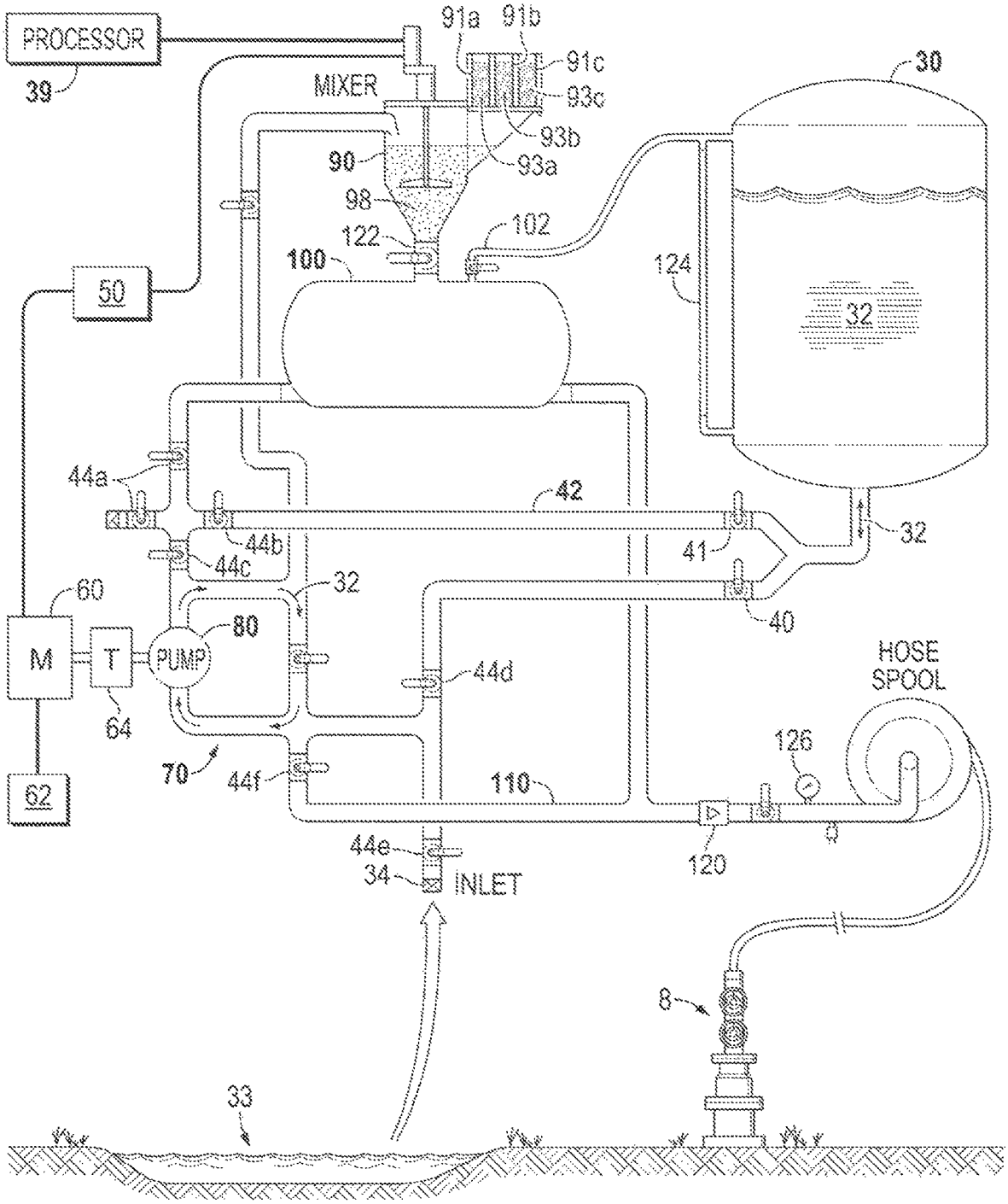
FIG. 2 depicts a flow schematic diagram according to one or more embodiments.

FIG. 2 depicts the flow of the fluid circulation loop 70 according to one or more embodiments.

A plurality of sequentially connected isolation valves 44*a* to 44*i* is shown for controlling the flow of liquid.

The single-pass flow-through dry chemical mixing trailer contains a liquid inlet valve 34 for receiving liquid 32 from a liquid source 33.

The liquid flows through the fluid circulation loop 70, which includes the self-priming bidirectional flow alternating centrifuge pump 80 to prevent the pump from malfunctioning while the valves are being opened and closed.

Figure 2A:
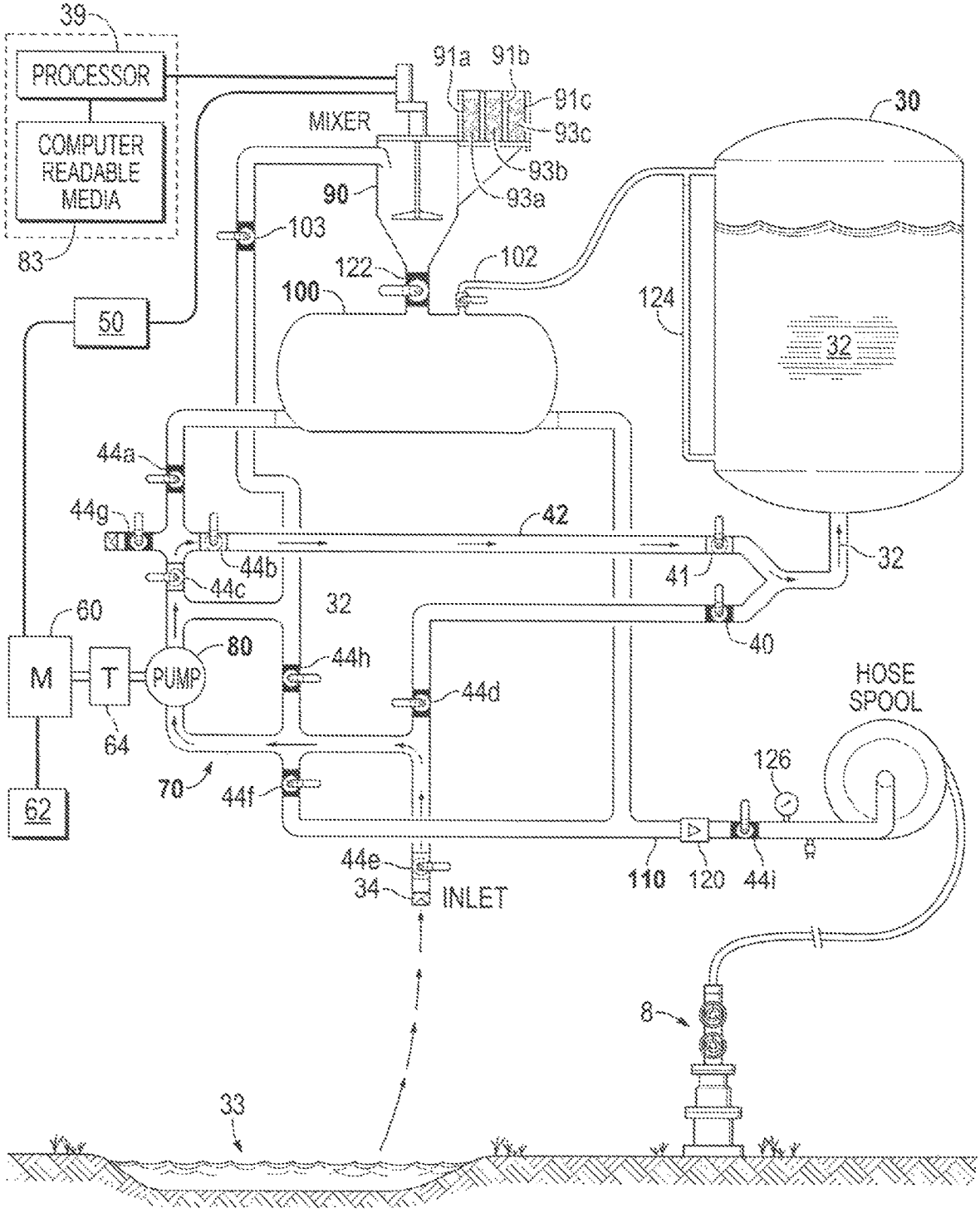
FIG. 2A depicts filling of the refillable liquid storage tank according to one or more embodiments.

FIG. 2A depicts filling of the refillable liquid storage tank 30.

In embodiments, a liquid inlet valve 34 receives liquid 32 from a liquid source 33. The liquid 32 flows through the self-priming bidirectional flow alternating centrifuge pump 80. From the self-priming bidirectional flow alternating centrifuge pump 80, the liquid 32 flows into the refillable liquid storage tank 30.

Figure 2B:
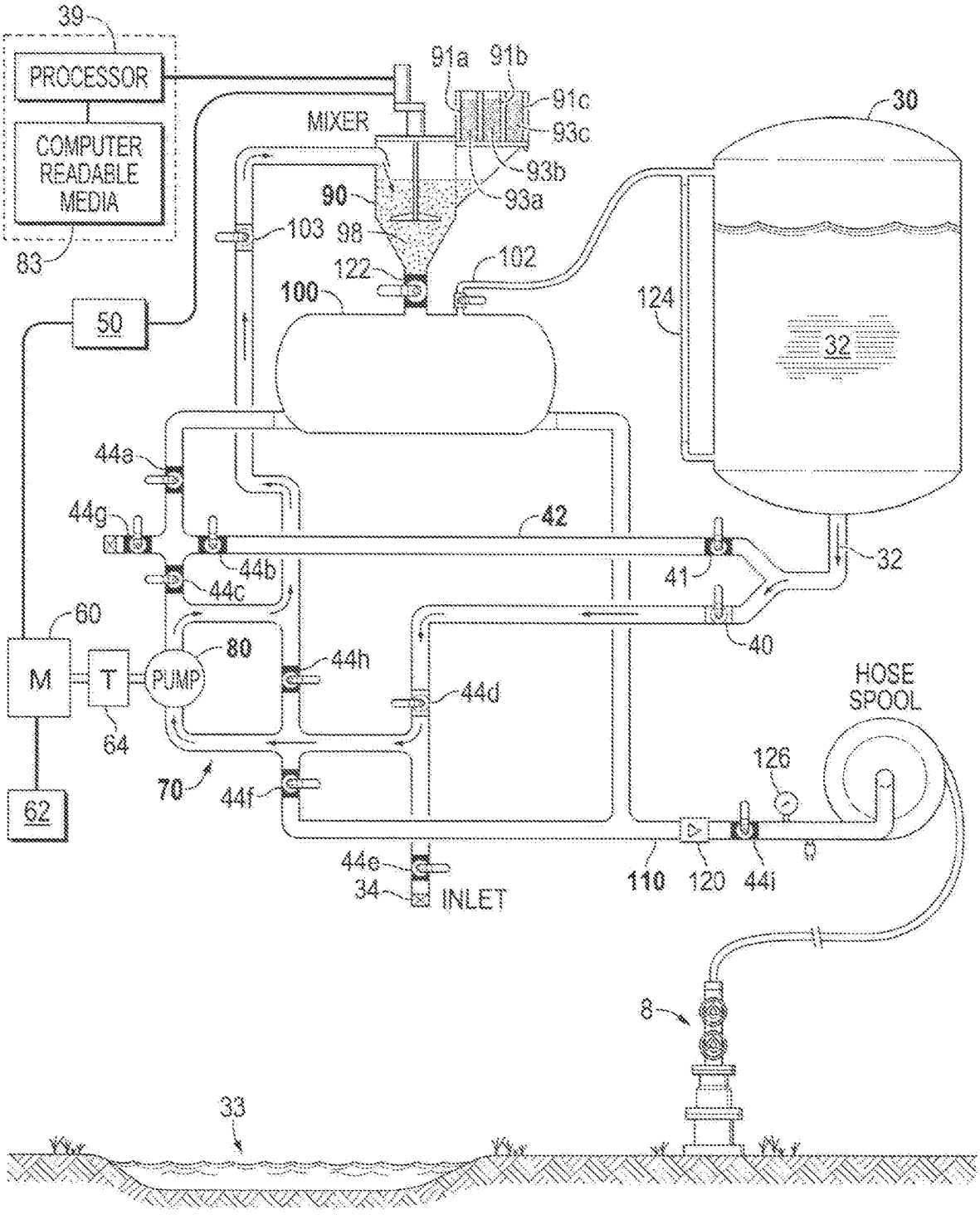
FIG. 2B depicts filling of the automated mixer assembly according to one or more embodiments.

FIG. 2B depicts filling of the automated mixer assembly.

In embodiments, the liquid 32 flows from the refillable liquid storage tank 30 through the fluid circulation loop 70. From the fluid circulation loop 70, the liquid 32 flows through the self-priming bidirectional flow alternating centrifuge pump 80 to the automated mixer assembly 90.

The single-pass flow-through dry chemical mixing trailer includes a mixing assembly valve 103 in communication with the controller for regulating liquid entering the automated mixing assembly 90.

Figure 2C:
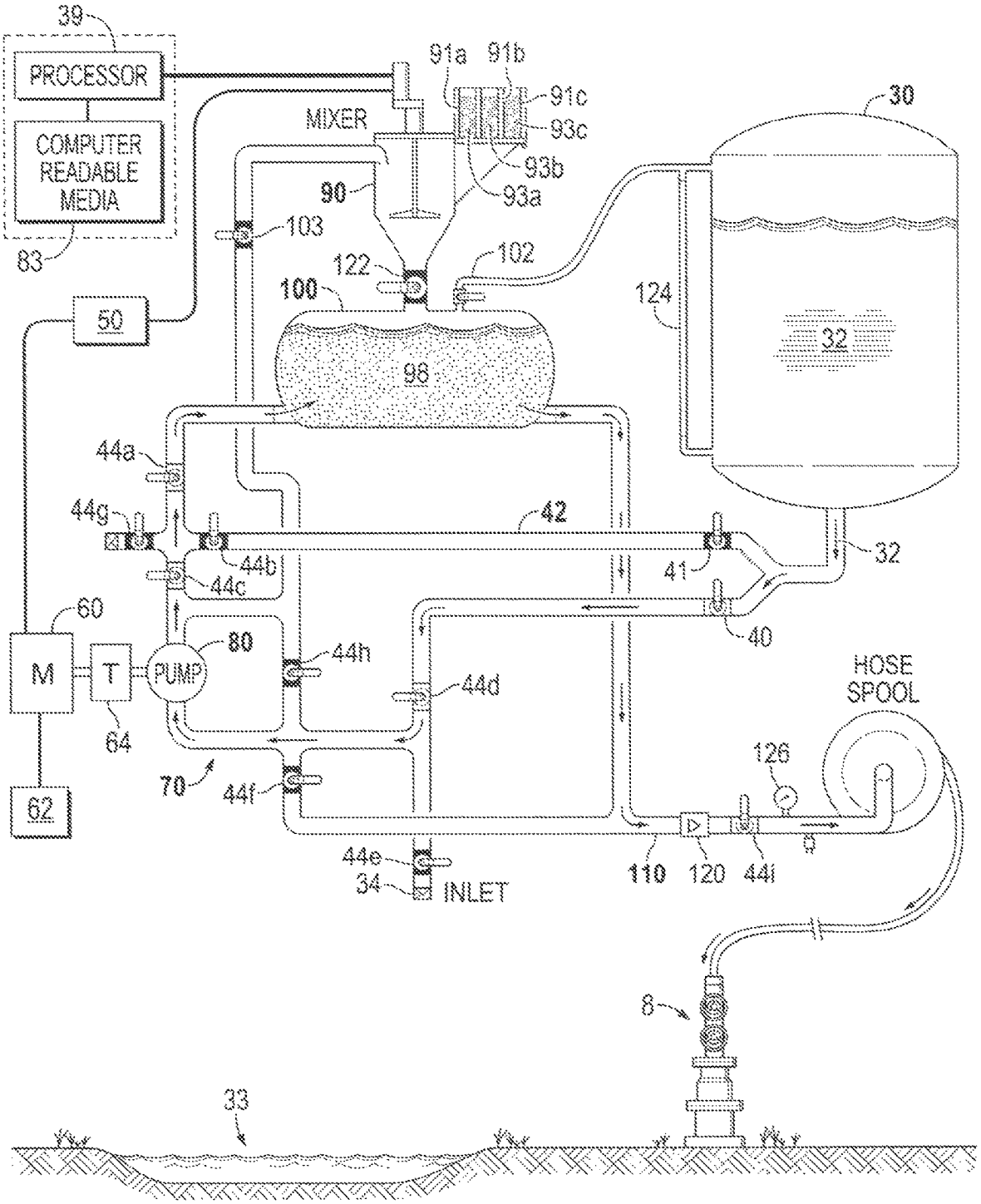
FIG. 2C depicts flushing into the well according to one or more embodiments.

FIG. 2C depicts flushing into the well.

In embodiments, liquid is pumped simultaneously from the refillable liquid storage tank 30 to the discharge tank 100 while flowing the homogenized slurry from the discharge tank 100 through the check valve 120 located in the conduit 110 to the well 8 to prevent the homogenized slurry from being pumped through the self-priming bidirectional flow alternating centrifuge pump 80.

Figure 3:
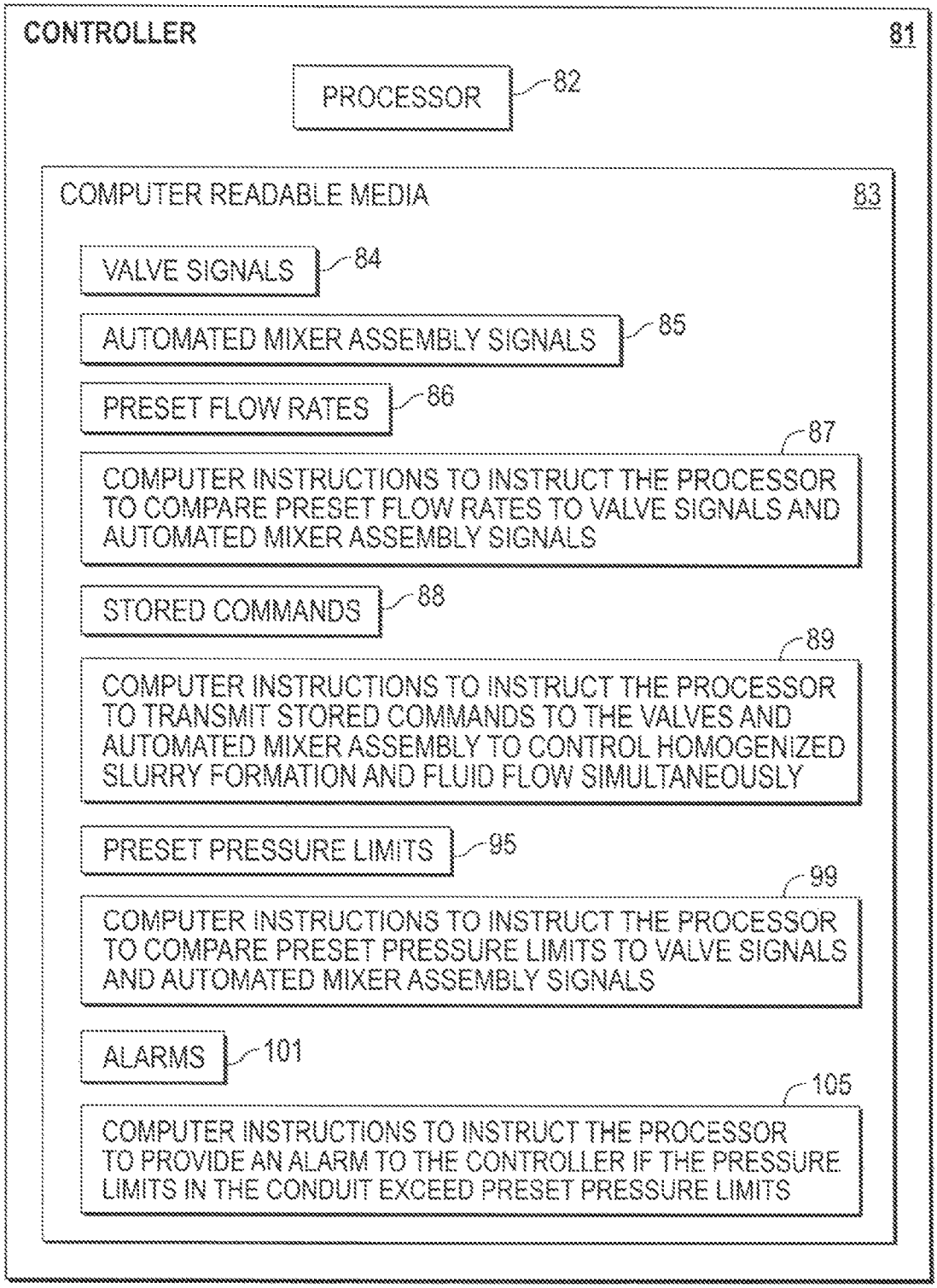
FIG. 3 depicts diagram of a controller according to one or more embodiments.

FIG. 3 depicts diagram of a controller 81 according to one or more embodiments.

The controller 81 with processor 82 and computer readable media 83 is mounted on the trailer.

The computer readable media 83 contains valve signals 84, automated mixer assembly signals 85, and preset flow rates 86.

In embodiments, the computer readable media 83 contains computer instructions 87 to instruct the processor 82 to compare preset flow rates to valve signals and automated mixer assembly signals.

The computer readable media 83 contains stored commands 88.

In embodiments, the computer readable media 83 contains computer instructions 89 to instruct the processor 82 to transmit stored commands to the valves and automated mixer assembly to control homogenized slurry formation and liquid flow simultaneously.

The computer readable media 83 contains preset pressure limits 95.

In embodiments, the computer readable media contains computer instructions 99 to instruct the processor to compare preset pressure limits to valve signals and automated mixer assembly signals.

The computer readable media 83 contains alarms 101.

In embodiments, the computer readable media 83 contains computer instructions to instruct the processor to provide an alarm to the controller if the pressure limits in the conduit exceed preset pressure limits.

Figure 4:
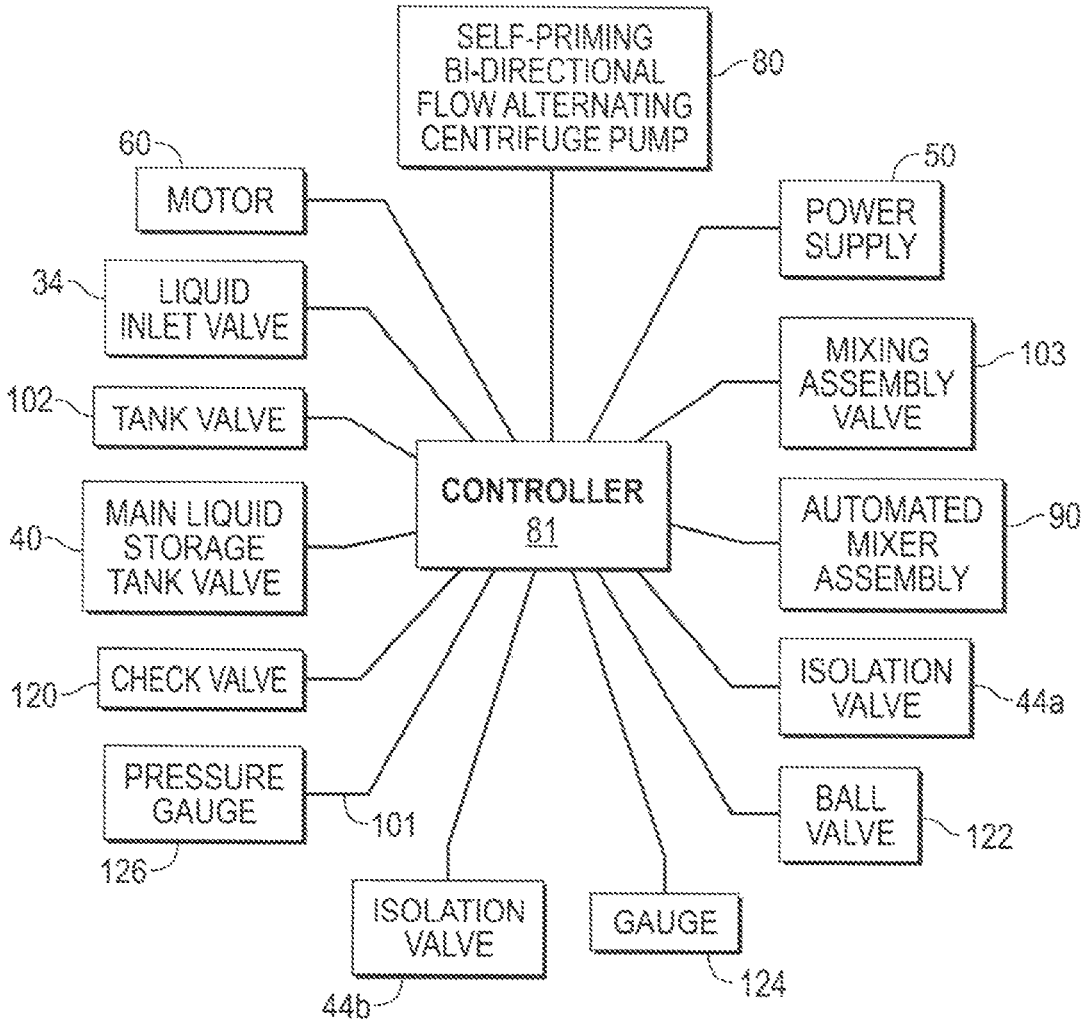
FIG. 4 depicts a diagram of the controller connectivity to equipment on the trailer for automatic mixing and flow control onboard according to one or more embodiments.

FIG. 4 depicts a diagram of the controller connectivity to equipment on the trailer for automatic mixing and flow control onboard according to one or more embodiments.

In embodiments, the controller is in communications with the self-priming bidirectional flow alternating centrifuge pump 80, the motor 60, the liquid inlet valve 34, air relief valve 102, the main liquid storage tank valve 40, the check valve 120, the pressure gauge 126 connected to the conduit for providing an alarm 101 to the controller if the pressure in the conduit exceeds preset pressure limits, isolation valves 44*a* and 44*b*, a gauge 124, a ball valve 122, an automated mixer assembly 90, a mixing assembly valve 103, and a power supply 50.

Figure 5:
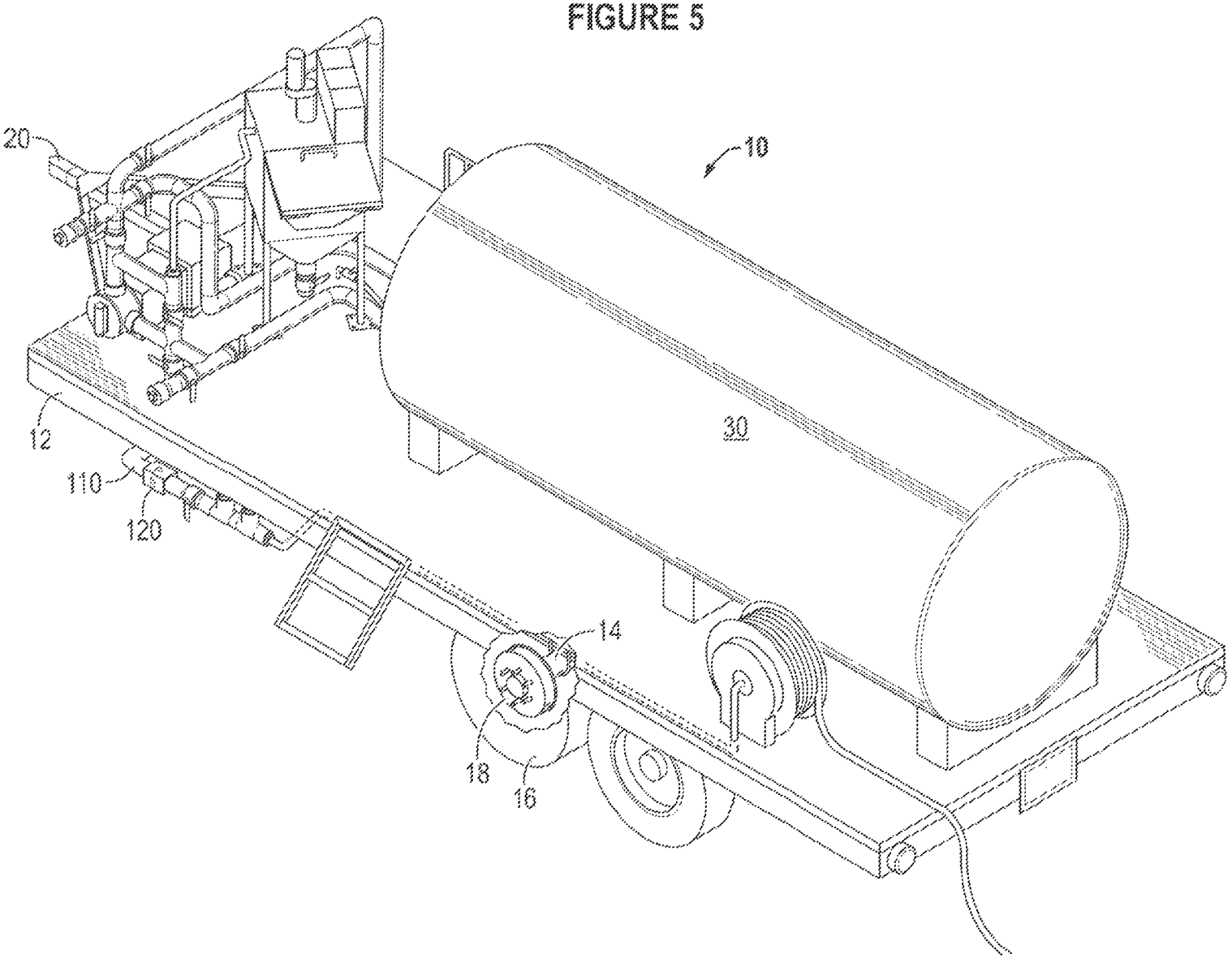
FIG. 5 depicts a top view of a trailer according to one or more embodiments.

FIG. 5 depicts a top view of a trailer useable herein.

The trailer 10 contains a frame 12, at least one axle 14, a pair of wheels 16 secured to the at least one axle 14, a brake 18 secured to the at least one axle, and a tow tongue 20 for engaging a tow vehicle.

In embodiments, a refillable liquid storage tank 30 is mounted on the trailer 10.

In embodiments, the trailer has a conduit 110 for flowing to the well, wherein the conduit can have an inner diameter from one inch to three inches.

A check valve 120 is located in the conduit 110 to control flow to the well. In embodiments, the check valve can be in communication with the controller.

EXAMPLES

Example 1

Example of Flowing Liquid Through the Fluid Circulation Loop:

Close sequentially connected isolation valves 44*a*, 44*c*, 44*d*, 44*f*, 44*g*, and close a main liquid storage tank valve 40 connected to the refillable liquid storage tank with a controller.

Open sequentially connected a liquid inlet valve 34 and isolation valves 44*e* for controlling liquid 32 from the liquid source 33 to the fluid circulation loop 70 with a controller. The liquid source can be fresh water from a water pit. The fresh water flows through the fluid circulation loop.

The fresh water is pulled in at a rate from one to five barrels a minute.

Example of Filling the Main Water Tank:

While the fresh water is circulating through the loop, close sequentially connected isolation valves 44*a*, 44*c*, 44*d*, 44*f*, 44*g*, and 44*h* and close a main liquid storage tank valve 40 connected to the refillable liquid storage tank with a controller.

Open sequentially connected isolation valves 44*b*, 44*c*, 44*e*, and liquid storage tank inlet valve 41 connected to the refillable liquid storage tank with a controller.

Pull in fresh water from a water pit into the fluid circulation loop using a self-priming bidirectional flow alternating centrifuge pump 80.

The fresh water is pulled in at a rate from one to five barrels a minute.

Pump the fresh water from fluid circulation loop 70 into a liquid inlet valve 34.

After filling the refillable liquid storage tank, close liquid inlet valve 34 and isolation valves 44*e*.

Example for Filling Automated Mixer Assembly:

Close liquid storage tank inlet valve 41 and sequentially connected isolation valves 44*b*, 44*c*, 44*e*, 44*g*, 44*f*, 44*h* and 44*i* with a controller.

Open sequentially connected isolation valves 44*d*, main liquid storage tank valve 40, and mixing assembly valve 103 with a controller.

Pump the fresh water from fluid circulation loop 70 to an automated mixer assembly 90.

The fresh water is pumped in at a rate from one-half to two barrels a minute.

The automated mixer receives fresh water as the high shear mixing assembly rotates creating a cyclone then chemicals, namely scale inhibitor, such as DC-229 and a corrosion inhibitor, such as DC-300 both available from Performance Chemical Company of Midland, Tex.

The ratio of fresh water to scale inhibitor to corrosion inhibitor can be 2:1:1.

The mixing of components can be turbulent mixing for five minutes. If other ratios are used the mixing can be up to 30 minutes to be sure all chemicals into a homogenized slurry.

The mixing occurs at ambient temperatures, which in Midland, Tex. can be 116 degrees Fahrenheit.

Example for Automatically Flushing a Well:

After mixing the homogenized slurry, open the ball valve 122 with a controller to allow the homogenized slurry to flow into the discharge tank.

Close liquid storage tank inlet valve 41 and sequentially connected isolation valves 44*b*, 44*e*, 44*f*, 44*g*, 44*h*, and mixing assembly valve 103 with the controller.

After all of the homogenized slurry in deposited into the discharge tank, close the ball valve 122 with a controller.

Open main liquid storage tank valve 40 and sequentially connected isolation valves 44*a*, 44*c*, 44*d*, and 44*i* with the controller.

Pump fresh water from the refillable liquid storage tank 30 to the discharge tank 100 while simultaneously flowing the homogenized slurry 98 from the discharge tank 100 through the check valve 120 located in the conduit 110 to the well 8 to prevent the homogenized slurry 98 from being pumped through the self-priming bidirectional flow alternating centrifuge pump 80.

The homogenized slurry is pumped to the well at a rate from one to five barrels a minute.

Example 2

Example of Flowing Liquid Through the Fluid Circulation Loop:

Close sequentially connected isolation valves 44*a*, 44*c*, 44*d*, 44*f*, 44*g*, and close a main liquid storage tank valve 40 connected to the refillable liquid storage tank with a controller.

Open sequentially connected a liquid inlet valve 34 and isolation valves 44*e* for controlling liquid 32 from the liquid source 33 to the fluid circulation loop 70 with a controller. The liquid source can be produced water from a tank battery. The produced water flows through the fluid circulation loop.

The produced water is pulled in at a rate from one to five barrels a minute.

Example of Filling the Main Water Tank:

While the produced water is circulating through the loop, close sequentially connected isolation valves 44*a*, 44*c*, 44*d*, 44*f*, 44*g*, and 44*h* and close a main liquid storage tank valve 40 connected to the refillable liquid storage tank with a controller.

Open sequentially connected isolation valves 44*b*, 44*c*, 44*e*, and liquid storage tank inlet valve 41 connected to the refillable liquid storage tank with a controller.

Pull in fresh water from a water pit into the fluid circulation loop using a self-priming bidirectional flow alternating centrifuge pump 80.

The fresh water is pulled in at a rate from one to five barrels a minute.

Pump the fresh water from fluid circulation loop 70 into a liquid inlet valve 34.

After filling the refillable liquid storage tank, close liquid inlet valve 34 and isolation valves 44*e*.

Example for Filling Automated Mixer Assembly:

Close liquid storage tank inlet valve 41 and sequentially connected isolation valves 44*b*, 44*c*, 44*e*, 44*g*, 44*f*, 44*h* and 44*i* with a controller.

Open sequentially connected isolation valves 44*d*, main liquid storage tank valve 40, and mixing assembly valve 103 with a controller.

Pump the produced water from fluid circulation loop 70 to an automated mixer assembly 90.

The produced water is pumped in at a rate from one-half to two barrels a minute.

The automated mixer receives produced water as the high shear mixing assembly rotates creating a cyclone then chemicals, namely water treatment, such as DC-WT and a paraffin inhibitor, such as DC-451 both available from Performance Chemical Company of Midland, Tex.

The ratio of produced water to water treatment to paraffin inhibitor can be 3:2:1.

The mixing of components can be turbulent mixing for five minutes. If other ratios are used the mixing can be up to 30 minutes to be sure all chemicals into a homogenized slurry.

The mixing occurs at ambient temperatures, which in Midland, Tex. can be 116 degrees Fahrenheit.

Example for Automatically Flushing a Well:

After mixing the homogenized slurry, open the ball valve 122 with a controller to allow the homogenized slurry to flow into the discharge tank.

Close liquid storage tank inlet valve 41 and sequentially connected isolation valves 44*b*, 44*e*, 44*f*, 44*g*, 44*h*, and mixing assembly valve 103 with the controller.

After all of the homogenized slurry in deposited into the discharge tank, close the ball valve 122 with a controller.

Open main liquid storage tank valve 40 and sequentially connected isolation valves 44*a*, 44*c*, 44*d*, and 44*i* with the controller.

Pump produced water from the refillable liquid storage tank 30 to the discharge tank 100 while simultaneously flowing the homogenized slurry 98 from the discharge tank 100 through the check valve 120 located in the conduit 110 to the well 8 to prevent the homogenized slurry 98 from being pumped through the self-priming bidirectional flow alternating centrifuge pump 80.

The homogenized slurry is pumped to the well at a rate from one to five barrels a minute.

While these embodiments have been described with emphasis on the embodiments, it should be understood that within the scope of the appended claims, the embodiments might be practiced other than as specifically described herein.

What is claimed is:

1. A single-pass flow-through dry chemical mixing trailer for use with a well comprising:

a. a trailer;

b. a refillable liquid storage tank mounted on the trailer providing a liquid;

c. a main liquid storage tank valve connected to the refillable liquid storage tank;

d. a liquid storage tank inlet valve connected to the refillable liquid storage tank;

e. an onboard power supply mounted on the trailer;

f. a motor with a fuel supply mounted to the trailer, the motor connected to the onboard power supply;

g. a transmission connected to the motor;

h. a fluid circulation loop connected to the main liquid storage tank valve to receive the liquid;

i. a self-priming bidirectional flow alternating centrifuge pump connected to the transmission for transferring the liquid via the fluid circulation loop sequentially to:

i. an automated mixer assembly that additionally receives dry chemicals from a plurality of detachable dry chemical containers forming a homogenized slurry; and ii. a discharge tank with an air relief valve configured to maintain pressure in the discharge tank between 14 psi and 50 psi, wherein the discharge tank additionally receives the homogenized slurry; and wherein the refillable liquid storage tank prevents backflow to the self-priming bidirectional flow alternating centrifuge pump while flowing the homogenized slurry to the well, and the dry chemicals introduced at the automated mixer assembly are subjected to high shear forces, incorporating the dry chemicals into the liquid with increased dispersion and reduced agglomeration.

2. The single-pass flow-through dry chemical mixing trailer of claim 1, comprising a controller with a processor and computer readable media mounted on the trailer for receiving valve signals and automated mixer assembly signals automatically comparing the valve signals and the automated mixer assembly signals to preset flow rates stored in the computer readable media and automatically transmitting stored commands from the computer readable media to the valves and the automated mixer assembly simultaneously to control the homogenized slurry formation and liquid flow simultaneously.

3. The single-pass flow-through dry chemical mixing trailer of claim 2, comprising a liquid inlet valve for receiving liquid from a liquid source and the liquid inlet valve in communication with the controller.

4. The single-pass flow-through dry chemical mixing trailer of claim 2, further comprising:

a. the conduit for flowing to the well; and b. a check valve in the conduit to control flow to the well, the check valve in communication with the controller.

5. The single-pass flow-through dry chemical mixing trailer of claim 4, wherein the conduit for flowing to the well has an inner diameter from 1 to 3 inches.

6. The single-pass flow-through dry chemical mixing trailer of claim 2, further comprising a ball valve between the automated mixer assembly and the discharge tank for controlling mixed liquid flow, the ball valve in communication with the controller.

7. The single-pass flow-through dry chemical mixing trailer of claim 2, comprising a pressure gauge connected to the conduit for providing an alarm to the controller if the pressure in the conduit exceeds preset pressure limits stored in the computer readable media of the controller.

8. The single-pass flow-through dry chemical mixing trailer of claim 1, wherein the trailer further comprises:

a. a frame;

b. at least one axle;

c. a pair of wheels secured to the at least one axle;

d. a brake secured to the at least one axle; and e. a tow tongue for engaging a tow vehicle.

9. The single-pass flow-through dry chemical mixing trailer of claim 1, comprising a conduit with a plurality of sequentially connected isolation valves for controlling liquid from the refillable liquid storage tank to the fluid circulation loop.

10. The single-pass flow-through dry chemical mixing trailer of claim 1, comprising a mixing assembly valve in communication with the controller for regulating liquid entering the automated mixing assembly.

11. The single-pass flow-through dry chemical mixing trailer of claim 1, wherein each isolation valve of the plurality is in electronic communication with the controller.

12. The single-pass flow-through dry chemical mixing trailer of claim 1, wherein the onboard power supply is a car battery or a generator capable of providing from 12 to 24 volts of DC power.

13. The single-pass flow-through dry chemical mixing trailer of claim 1, wherein the motor is an electric start gas powered motor.

14. The single-pass flow-through dry chemical mixing trailer of claim 1, wherein the automated mixer assembly comprises:

a. a tank for receiving sequentially a liquid and the dry chemicals;

b. a mixing nozzle creating turbulent mixing in the tank; and c. a high-shear assembly in the tank for incorporating the dry chemicals into the liquid forming the homogenized slurry.

15. The single-pass flow-through dry chemical mixing trailer of claim 1, wherein the fuel supply is diesel or gas.

16. The single-pass flow-through dry chemical mixing trailer of claim 1, further comprising a gauge for determining quantities of a liquid removed from a refillable liquid storage tank enabling continuous monitoring of the liquid to the automated mixer assembly by the controller.

17. The single-pass flow-through dry chemical mixing trailer of claim 1, comprising mixing a ratio of 1 pound to 2 pounds of the dry chemical to 1 to 2 barrels of liquid.

18. The single-pass flow-through dry chemical mixing trailer of claim 1, comprising a refillable liquid storage tank mounted on the trailer has from 100 to 300 gallons of liquid.

* * * * *